US010883688B2

(12) United States Patent
Inoue

(10) Patent No.: US 10,883,688 B2
(45) Date of Patent: Jan. 5, 2021

(54) LAMP DEVICE FOR VEHICLE

(71) Applicant: HONDA MOTOR CO., LTD., Tokyo (JP)

(72) Inventor: Naoto Inoue, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/427,747

(22) Filed: May 31, 2019

(65) Prior Publication Data

US 2019/0285240 A1 Sep. 19, 2019

Related U.S. Application Data

(63) Continuation of application No. PCT/JP2017/038249, filed on Oct. 24, 2017.

(30) Foreign Application Priority Data

Jan. 26, 2017 (JP) ..... 2017-012537

(51) Int. Cl.
*F21S 41/20* (2018.01)
*F21S 41/32* (2018.01)
(Continued)

(52) U.S. Cl.
CPC ..... *F21S 41/20* (2018.01); *F21S 41/00* (2018.01); *F21S 41/32* (2018.01); *F21S 43/00* (2018.01);
(Continued)

(58) Field of Classification Search
CPC .. F21S 41/20; F21S 41/26; F21S 41/32; F21S 41/50; F21S 43/50
See application file for complete search history.

(56) References Cited

U.S. PATENT DOCUMENTS 6,494,603 B1 * 12/2002 Takada ..... F21S 41/43 362/538
6,883,938 B1 * 4/2005 Kohara ..... F21V 7/28 362/296.04
(Continued)

FOREIGN PATENT DOCUMENTS

JP H4-054102 U 5/1992
JP H8-222014 A 8/1996
(Continued)

OTHER PUBLICATIONS

International Search Report for PCT/JP2017/038249 dated Dec. 5, 2017 (partially translated).

*Primary Examiner* — William N Harris
(74) *Attorney, Agent, or Firm* — Thomas | Horstemeyer, LLP

(57) ABSTRACT

A lamp device for vehicle 1 comprises a light source 2, an inner lens 3 configured to accept light of the light source 2, and a housing 5 configured to cover a periphery of the light source unit 2 and the inner lens 3. When a traveling direction of a light beam with a largest light amount in the light emitted from the light source 2 is defined as front, the housing 5 includes a back surface portion 51 located on a rear side of the inner lens 3, and a lower surface portion 53 located on a lower side of the inner lens 3, the lower surface portion 53 includes an extended portion 53*a* extended to a front side of a front surface portion 31*a* of the inner lens 3.

2 Claims, 6 Drawing Sheets

(51) Int. Cl.

| | |
|---|---|
| ***F21S 45/00*** | (2018.01) |
| ***F21S 41/00*** | (2018.01) |
| ***F21S 43/00*** | (2018.01) |
| ***F21S 43/50*** | (2018.01) |
| ***F21S 43/20*** | (2018.01) |
| ***F21S 43/14*** | (2018.01) |

(52) U.S. Cl.
CPC ..... *F21S 43/14* (2018.01); *F21S 43/26* (2018.01); *F21S 43/50* (2018.01); *F21S 45/00* (2018.01)

(56) References Cited

U.S. PATENT DOCUMENTS

| | | | | |
|---|---|---|---|---|
| 7,726,857 | B2 * | 6/2010 | Nakada | F21S 41/43 362/518 |
| 2004/0061963 | A1 * | 4/2004 | Inaba | F21S 43/33 359/883 |
| 2006/0209557 | A1 * | 9/2006 | Komatsu | F21S 41/172 362/539 |
| 2007/0019431 | A1 * | 1/2007 | Kinoshita | F21S 41/675 362/517 |

FOREIGN PATENT DOCUMENTS

| | | | |
|---|---|---|---|
| JP | 2015-065035 | A | 4/2015 |
| WO | 2018/138987 | A1 | 8/2018 |

* cited by examiner

LAMP DEVICE FOR VEHICLE

CROSS-REFERENCE TO RELATED APPLICATION(S)

This application is a continuation of International Patent Application No. PCT/JP2017/038249 filed on Oct. 24, 2017, which claims priority to and the benefit of Japanese Patent Application No. 2017-012537 filed on Jan. 26, 2017, the entire disclosures of which are incorporated herein by reference.

TECHNICAL FIELD

The present invention relates to a lamp device for vehicle applied to the headlight of an automobile or the like.

BACKGROUND ART

Japanese Utility-Model Laid-Open No. 4-54102 discloses a structure in which an inner lens is arranged in front of a plurality of light sources (a light emitting diode and an optical fiber) arranged in the vehicle width direction.

In Japanese Utility-Model Laid-Open No. 4-54102 described above, a lamp body surrounds the lower surface and the back surface of the inner lens. However, if the lamp body is wholly colored black so it can hardly reflect light such as sunlight, the color of the lamp body is reflected on the inner lens in the off state, and the whole combination lamp looks dark.

To the contrary, in a case in which the entire lamp body 11 undergoes high reflection processing by deposition or coloring, the whole lamp becomes bright, and the inner lens 13 relatively becomes unnoticeable. It is therefore impossible to improve designability in a case of an inner lens with a characteristic shape.

SUMMARY OF THE INVENTION

The present invention has been made in consideration of the above-described problems, and implements a lamp device for vehicle capable of improving designability in a case of an inner lens with a characteristic shape by making the periphery of the inner lens look dark but the inner lens itself look bright.

In order to solve the above-described problems and achieve the object, according to the present invention, there is provided a lamp device for vehicle comprising a light source, an inner lens configured to accept light of the light source, and a housing configured to cover a periphery of the light source unit and the inner lens, wherein when a traveling direction of a light beam with a largest light amount in the light emitted from the light source is defined as front, the housing includes a back surface portion located on a rear side of the inner lens, and a lower surface portion located on a lower side of the inner lens, the lower surface portion includes an extended portion extended to a front side of a front surface portion of the inner lens, the extended portion is provided with a high reflecting portion having a reflecting characteristic higher than that of a remaining portion of the housing, and the high reflecting portion guides, to the inner lens, light other than the light emitted from the light source.

Advantageous Effects of Invention

According to the present invention, it is possible to improve designability in a case of an inner lens with a characteristic shape by making the periphery of the inner lens look dark but the inner lens itself look bright.

Other features and advantages of the present invention will be apparent from the following descriptions taken in conjunction with the accompanying drawings, in which like reference characters designate the same parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

DESCRIPTION OF EMBODIMENTS

An embodiment of the present invention will now be described in detail with reference to the accompanying drawings.

Figure 1:
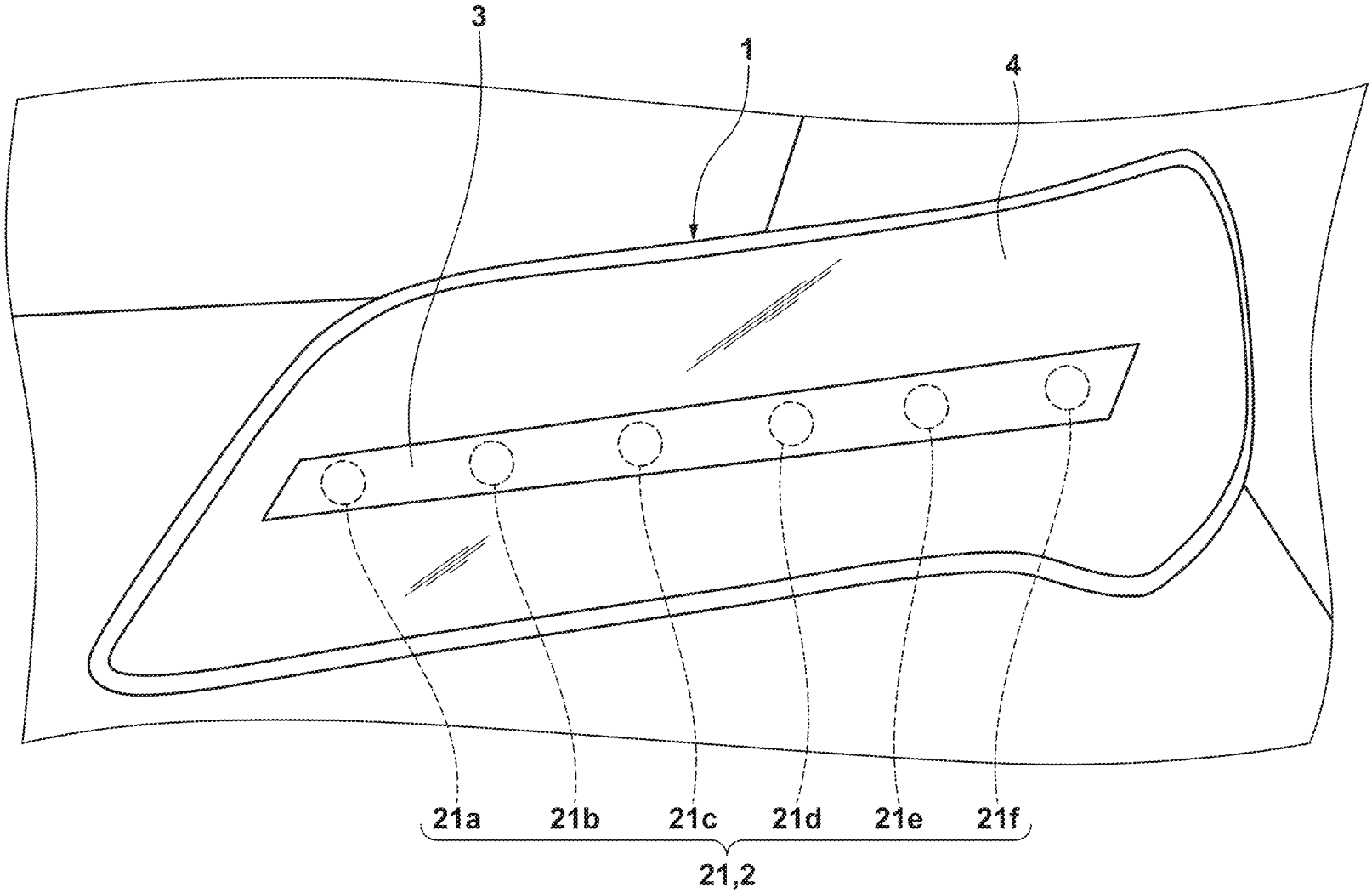
FIG. 1 is a view showing the outer appearance of a lamp device for vehicle according to the embodiment.

As shown in FIG. 1, a lamp device for vehicle according to this embodiment is applied to, for example, a headlight, a rear combination lamp, a side turn light, or the like of an automobile. In this embodiment, an example in which the lamp device for vehicle according to the present invention is applied to a headlight 1 of an automobile will be described. Note that in this specification, a traveling direction A of light emitted from a light source is defined as front (front side, front direction, or frontward), a direction opposite to the traveling direction A by 180° is defined as rear (rear side, rear direction, or rearward), and a direction (the normal direction to the page of FIG. 2) orthogonal to both the front-and-rear direction and the vertical direction is defined as lateral (lateral direction or left-and-right direction). According to the definitions, for example, in the case of the headlight 1 of the automobile, the front-and-rear direction is the vehicle longitudinal direction, and the lateral direction is the vehicle width direction. Additionally, for a tail lamp, the front-and-rear direction is reversed. For a side lamp, the front-and-rear direction is the vehicle width direction, and the lateral direction is the vehicle longitudinal direction.

Figure 2:
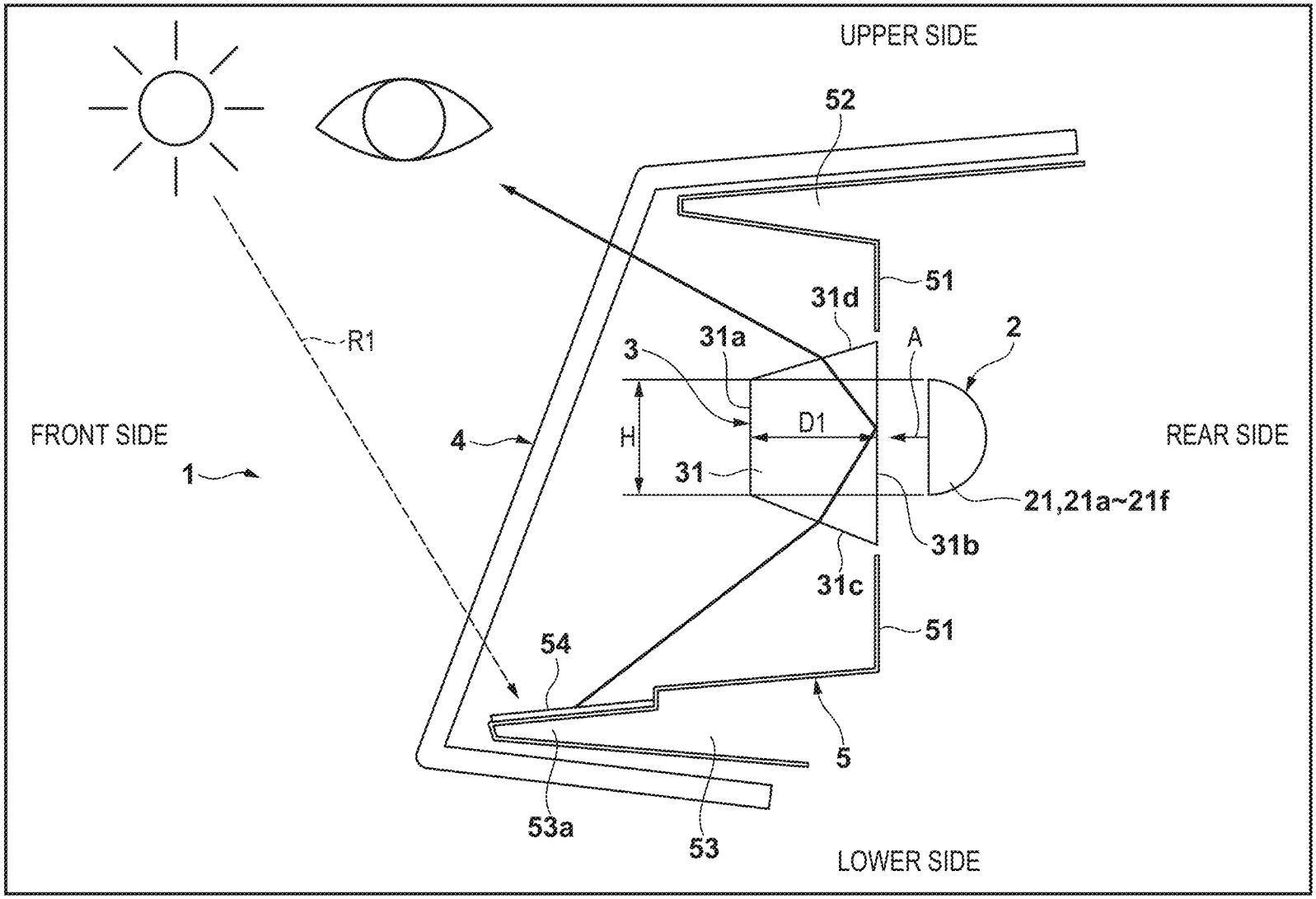
FIG. 2 is a schematic sectional view of the lamp device for vehicle according to the embodiment.

As shown in FIGS. 1 and 2, the headlight 1 includes a light source unit 2, an inner lens 3, an outer lens 4, and a housing 5 that stores the light source unit 2 and the inner lens 3. The light source unit 2 includes a light emitting portion 21. The light emitting portion 21 includes a plurality of (for example, six) light sources 21*a* to 21*f* arranged in the lateral direction, and the light sources 21*a* to 21*f* each include an LED (Light Emitting Diode). The light sources 21*a* to 21*f* of the light emitting portion 21 are arranged in the lateral direction at a predetermined interval.

The inner lens 3 is a long member extending in the lateral direction, and is an optical member that is arranged to face the front side of the light source unit 2, accepts and diffuses light radiated from the light sources 21*a* to 21*f* of the light emitting portion 21, and makes the light exit. The inner lens 3 includes a lens portion 31 arranged to face the light emitting portion 21 of the light source unit 2. A height H of a front surface portion 31*a* of the lens portion 31 in the vertical direction is almost the same as the height of the light emitting portion 21 of the light source unit 2 in the vertical direction, and the lens portion 31 extends in the lateral direction. The lens portion 31 is provided with an optical function portion for each of the light sources 21*a* to 21*f* of the light emitting portion 21. The optical function portion is a function of, for example, condensing and diffusing (diverging) the light emitted from each of the light sources 21*a* to 21*f* of the light emitting portion 21 and making the light exit. The lens portion 31 has a convex shape on the front side (light exit side), and is integrally made of an optically transparent resin material (polypropylene, acrylic resin, ABS, or the like).

In addition, the lens portion 31 of the inner lens 3 includes the front surface portion 31*a*, a rear surface portion 31*b* facing the light emitting portion 21 on the back side of the front surface portion 31*a*, a lower inclined surface 31*c* that tilts downward from the lower end of the front surface portion 31*a* toward the light emitting portion 21 on the rear side, and an upper inclined surface 31*d* that tilts upward from the upper end of the front surface portion 31*a* toward the light emitting portion 21 on the rear side. A thickness D1 (the distance between the front surface portion and the rear surface portion) of the lens portion 31 of the inner lens 3 is made larger than a predetermined thickness D0 to be described later, which allows the light that has entered from the lower inclined surface 31*c* to be reflected by the rear surface portion 31*b* and then exit from the upper inclined surface 31*d* without being reflected by the front surface portion 31*a*.

The housing 5 includes a back surface portion 51 that extends in the vertical direction to surround the upper edge portion and the lower edge portion of the inner lens 3, an upper surface portion 52 projecting frontward from the upper end of the back surface portion 51, and a lower surface portion 53 projecting frontward from the lower end of the back surface portion 51, and has a U-shaped outer shape in which a long hole to arrange the inner lens 3 is formed in the bottom portion. The back surface portion 51 is located at almost the same position as the rear surface portion 31*b* (light incident surface) of the lens portion 31, and the upper surface portion 52 and the lower surface portion 53 project frontward relative to the front surface portion 31*a* of the lens portion 31. In addition, the lower surface portion 53 includes an extended portion 53*a* that further projects frontward relative to the upper surface portion 52. The upper surface of the extended portion 53*a* is provided with a high reflecting portion 54 having a light reflecting characteristic higher than that of the remaining portion of the housing 5. In other words, the lower surface portion 53 other than the high reflecting portion 54 and the back surface portion 51 are low reflecting portions colored black and having a light reflecting characteristic lower than that of the high reflecting portion 54. For example, a deposition surface of a high reflecting material or a reflecting surface with a pattern is formed on the high reflecting portion 54.

The outer lens 4 is arranged to cover the front surface, the upper surface portion 52, and the lower surface portion 53 of the housing 5. Like the inner lens 3, the outer lens 4 is made of an optically transparent resin material or glass. However, an optical function portion (stepped portion) that condenses and diffuses the light that has exited from the inner lens 3 is not formed on the inner surface and the outer surface, which are the light incident side and the light exit side of the outer lens 4. In other words, the outer lens 4 includes a smooth lens surface (the surface on the light source unit side) that refracts, by its thickness, the light that has exited from the inner lens 3 but does not have the function of condensing and diffusing the light. The outer lens 4 is also integrally made of an optically transparent resin material (polypropylene, acrylic resin, ABS, or the like).

<Irradiation Direction of Each Light Source>

The headlight 1 according to this embodiment is configured such that light beams radiated from the light sources 21*a* to 21*f* of the light emitting portion 21 of the light source unit 2 illuminate different irradiation ranges via the inner lens 3. As for the irradiation directions of the light beams radiated from the light sources 21*a* to 21*f* of the light emitting portion 21, when a high luminance region that is bright because of the largest light amount (high radiation intensity or light intensity) of the light beams radiated from the light sources is called an optical axis direction, the optical axis direction changes between the light sources 21*a* to 21*f*. The irradiation range corresponds to a predetermined range spreading from the optical axis direction of each of the light sources 21*a* to 21*f* to the periphery. The inner lens 3 sets the irradiation directions of the light sources 21*a* to 21*f* such that the irradiation direction is directed from the inner side to the outer side in the vehicle width direction in the order of the light source 21*a* on the innermost side (vehicle width center side) in the vehicle width direction to the light source 21*f* on the outer side.

More specifically, as shown in FIGS. 4A to 4F and 5, the light sources 21*a* to 21*f* of the light emitting portion 21 of the light source unit 2 are defined as the first light source 21*a*, the second light source 21*b*, . . . , and the sixth light source 21*f* from the inner side to the outer side in the vehicle width direction, the vehicle longitudinal direction is defined as a reference direction, and an angle θ clockwise from the reference direction is defined as positive. In this case, the irradiation directions with respect to the reference direction are set to −θ1 for the first light source 21*a*, −θ2 for the second light source 21*b*, θ3 (=0 (reference direction)) for the third light source 21*c*, +θ4 for the fourth light source 21*d*, +θ5 for the fifth light source 21*e*, and +θ6 for the sixth light source 21*f*. In this case, the irradiation directions −θ1 to +θ6 of the light sources 21*a* to 21*f* may have equal intervals (for example, intervals of 15°) or different intervals.

In the headlight 1 according to this embodiment having the above-described arrangement, different irradiation directions and irradiation ranges can be set for the light sources by the inner lens 3. This can prevent glare for a walker or an oncoming vehicle, which occurs when an unwanted range is illuminated in a region with a large irradiation light amount.

Additionally, when the inner lens 3 is viewed from the outside, a given light source is brightest in the irradiation direction and its periphery looks dark. However, when the irradiation direction is changed between the light sources arranged the vehicle width direction, a visual effect of continuously moving the high luminance region along with a change in the relative position to the user who views the lens can be obtained, and designability can be improved.

In addition, the height H of the front surface portion 31*a* of the lens portion 31 of the inner lens 3 in the vertical direction is almost the same as the height of the light emitting portion 21 of the light source unit 2 in the vertical direction. For this reason, the whole lens can be constructed so a high luminance region and a low luminance region are not formed in the vertical direction, and lowering of the designability can be suppressed.

The outer lens 4 arranged in front of the inner lens 3 includes a smooth lens surface that has not undergone diffusion and condensing processing. Accordingly, the housing 5, the inner lens 3, and the light source unit 2 can be protected by the outer lens 4. In addition, since the outer lens 4 does not diffuse/condense the light emitted from the light source, the user can directly visually recognize the lens from the outside and directly feel the designability by the lens.

When the irradiation directions of the light sources are set at equal intervals, the visual effect of continuously smoothly moving the high luminance region is obtained along with the movement of the user relative to the lens and the change in the direction of viewing the lens, and designability can be improved.

As described above, according to this embodiment, without illuminating an unwanted region, the visual effect of moving the high luminance region along with the change in the relative position to the user who views the lens can be obtained, and the designability can thus be improved.

<Light Reflection Function of Inner Lens>

Figure 3:
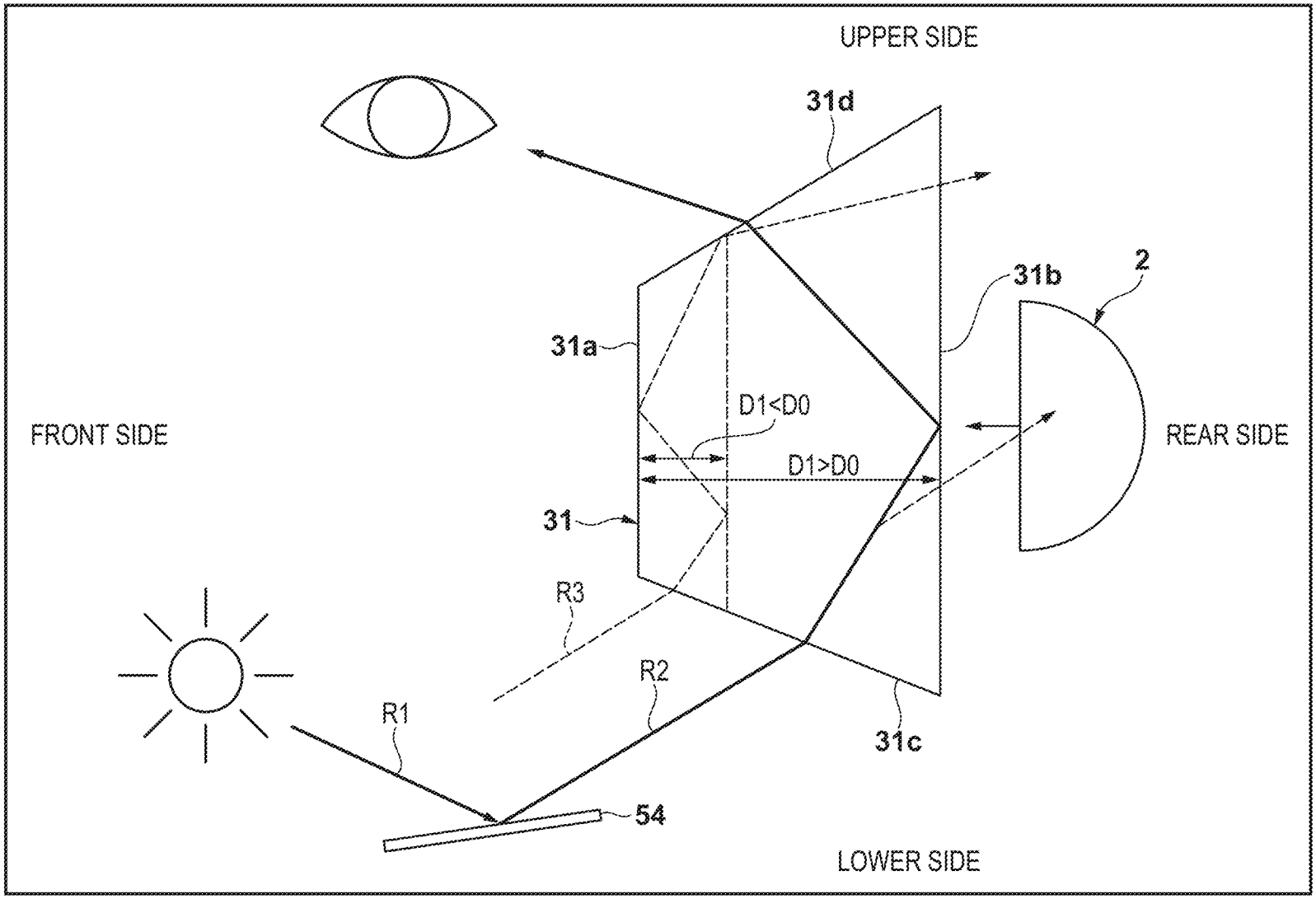
FIG. 3 is a schematic sectional view for explaining the high reflection function of the inner lens of the lamp device for vehicle according to the embodiment.
Figure 4A:
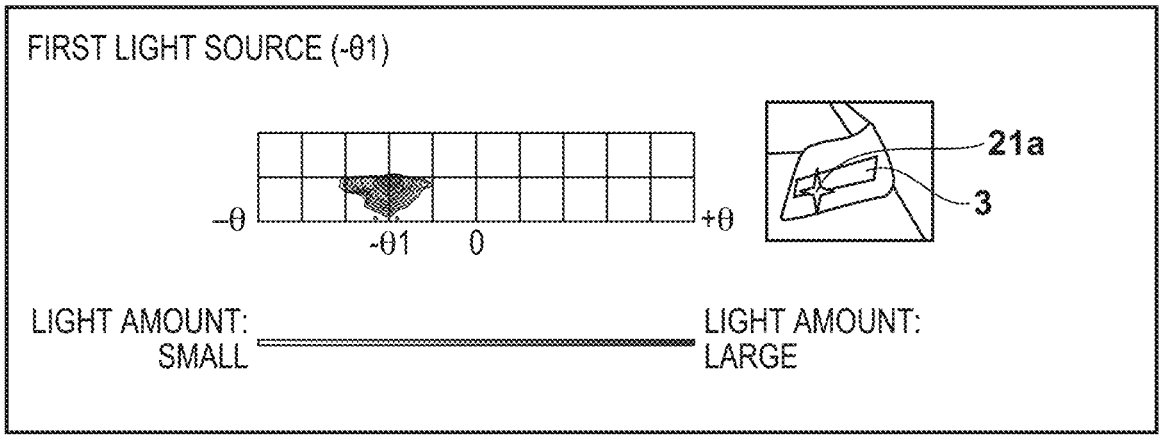
FIG. 4A is a view showing the irradiation direction and the irradiation range of each light source of the lamp device for vehicle according to the embodiment.
Figure 4B:
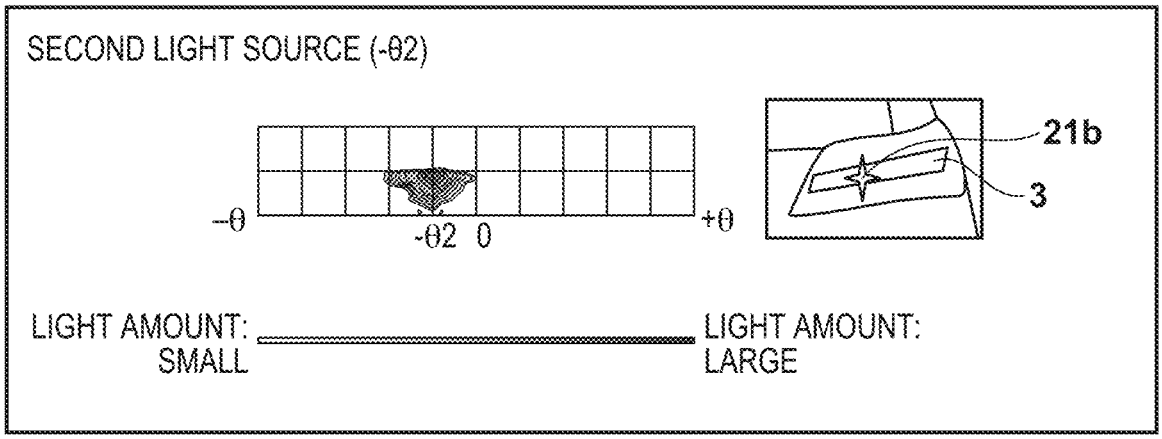
FIG. 4B is a view showing the irradiation direction and the irradiation range of each light source of the lamp device for vehicle according to the embodiment.
Figure 4C:
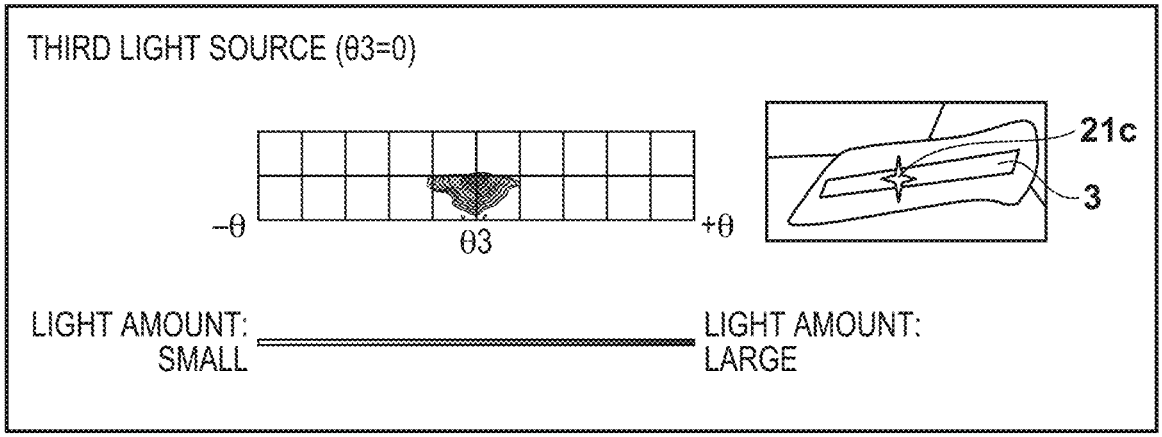
FIG. 4C is a view showing the irradiation direction and the irradiation range of each light source of the lamp device for vehicle according to the embodiment.
Figure 4D:
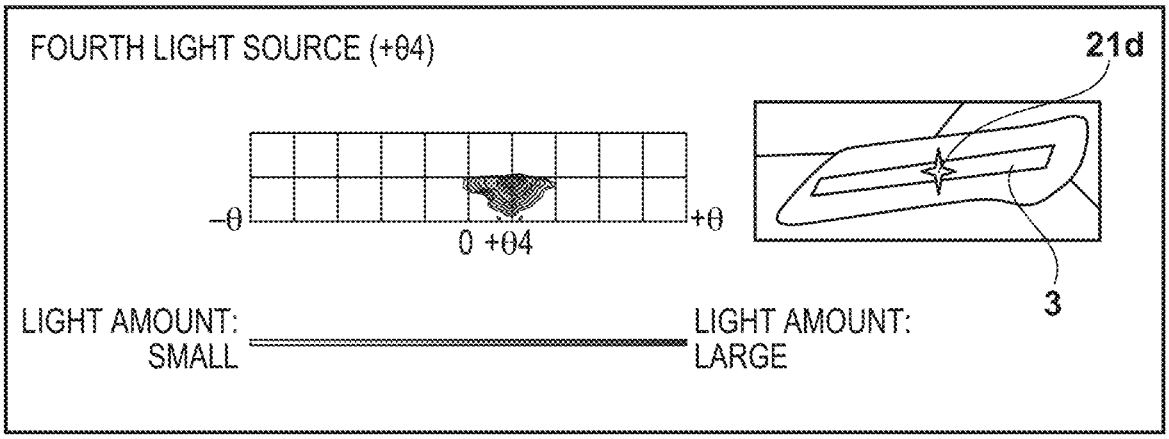
FIG. 4D is a view showing the irradiation direction and the irradiation range of each light source of the lamp device for vehicle according to the embodiment.
Figure 4E:
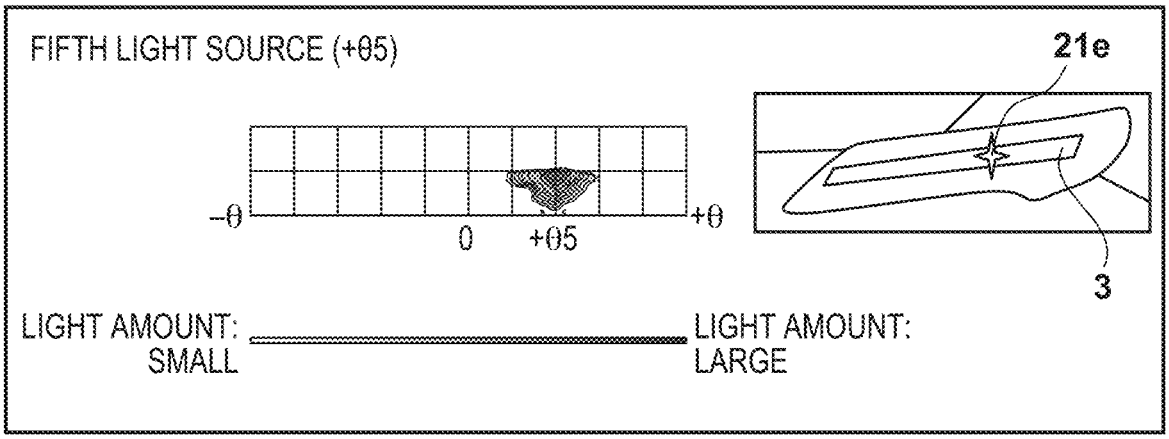
FIG. 4E is a view showing the irradiation direction and the irradiation range of each light source of the lamp device for vehicle according to the embodiment.
Figure 4F:
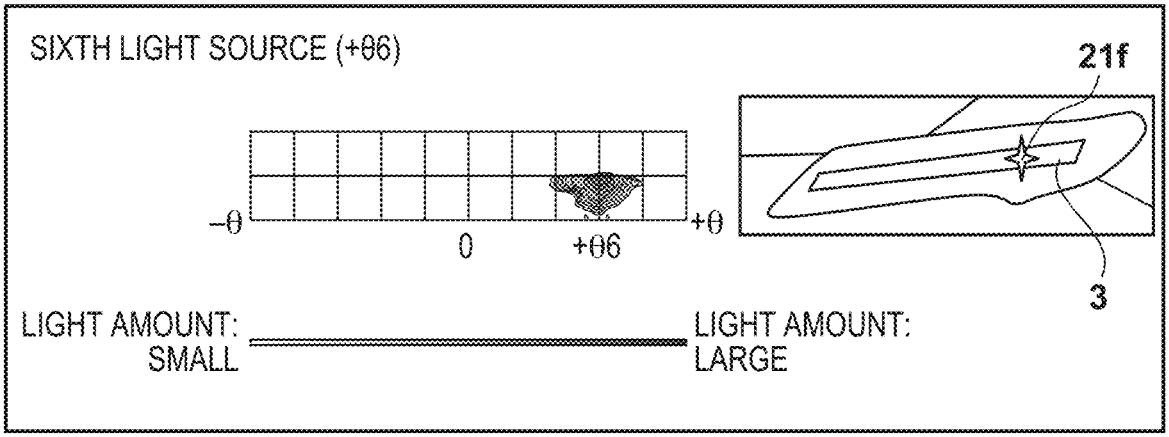
FIG. 4F is a view showing the irradiation direction and the irradiation range of each light source of the lamp device for vehicle according to the embodiment.
Figure 5:
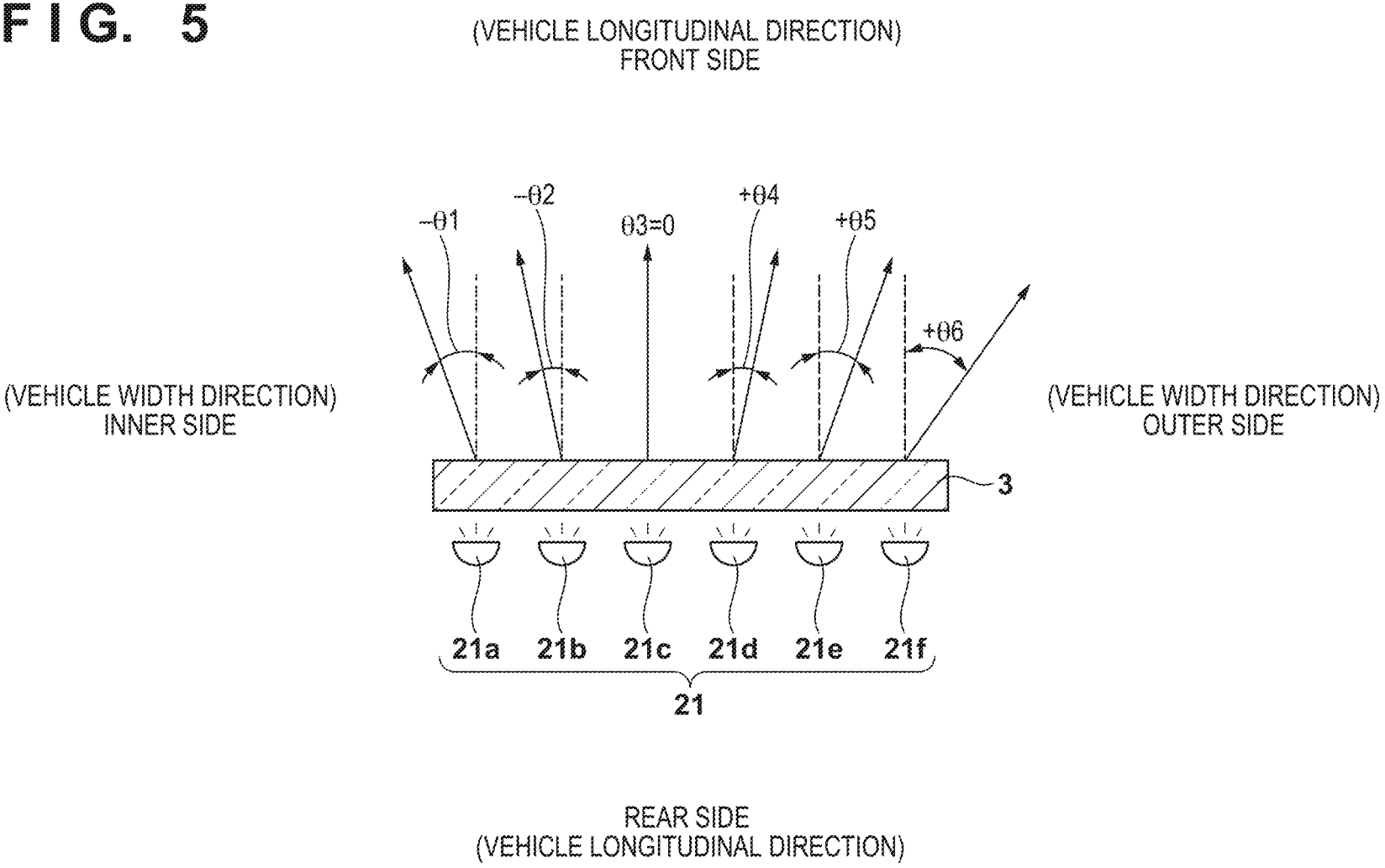
FIG. 5 is a view showing the irradiation direction of each light source of the lamp device for vehicle according to the embodiment viewed from the upper side of the vehicle body.

As shown in FIGS. 2 and 3, external light (light other than the light emitted from the light source unit 2) R1 such as sunlight that enters from the outside via the outer lens 4 is reflected by the high reflecting portion 54, enters from the lower inclined surface 31*c* of the inner lens 3, is reflected by the rear surface portion 31*b*, and exits from the upper inclined surface 31*d*. This can make the inner lens 3 glitter in the daytime when the light emitting portion 21 is not on. In addition, since the lower surface portion 53 other than the high reflecting portion 54 and the back surface portion 51 look dark, the inner lens 3 appears, and the designability featured by the shape of the inner lens 3 can be improved.

Additionally, as shown in FIG. 3, if the thickness D1 (<D0) of the lens portion 31 (the broken line in FIG. 3) of the inner lens 3 is insufficient, light R3 that is reflected by the high reflecting portion 54 and enters from the lower inclined surface 31*c* causes multiple reflection between the rear surface portion 31*b* and the front surface portion 31*a*. Some light components do not reach the upper inclined surface 31*d* or are reflected by the upper inclined surface 31*d*, and does not exit from the upper inclined surface 31*d*.

On the other hand, when the thickness D1 of the lens portion 31 (the solid line in FIG. 3) of the inner lens 3 is made larger than the predetermined thickness D0 (a thickness that allows the external light to be reflected by the high reflecting portion 54, enter from the lower inclined surface 31*c*, to be reflected by the rear surface portion 31*b*, and then exit from the upper inclined surface 31*d* without being reflected by the front surface portion 31*a*) (D1>D0), light R2 reflected by the high reflecting portion 54 can efficiently be caused to exit from the upper inclined surface 31*d*, as shown in FIG. 3. Hence, the inner lens 3 can be made to glitter well.

Note that a lamp device for vehicle such as the headlight 1 according to this embodiment is normally provided at a position lower than the viewpoint of a human. For this reason, in this embodiment, the outer appearance is improved by making the upper inclined surface of the inner lens 3 glitter.

As described above, according to this embodiment, the periphery of the inner lens 3 is dark, and the inner lens 3 itself is shown bright, thereby improving the designability only by making a contrivance to the shape of the inner lens 3.

Note that the above-described embodiment is an example of an implementation means of the present invention. The present invention is applicable to a change or a modification of the embodiment without departing from the scope of the invention. In this embodiment, a lamp device for vehicle has been described. However, the present invention is not limited to this and is applicable or various application purposes other than a vehicle.

Summary of Embodiment

<First Aspect>

There is provided a lamp device for vehicle 1 comprising:

a light source 2;

an inner lens 3 configured to accept light of the light source 2; and a housing 5 configured to cover a periphery of the light source unit 2 and the inner lens 3, wherein when a traveling direction of a light beam with a largest light amount in the light emitted from the light source 2 is defined as front, the housing 5 includes a back surface portion 51 located on a rear side of the inner lens 3, and a lower surface portion 53 located on a lower side of the inner lens 3, the lower surface portion 53 includes an extended portion 53*a* extended to a front side of a front surface portion 31*a* of the inner lens 3, the extended portion 53*a* is provided with a high reflecting portion 54 having a reflecting characteristic higher than that of a remaining portion of the housing 5, and the high reflecting portion 54 guides, to the inner lens 3, light other than the light emitted from the light source 2.

According to the first aspect, the external light R1 such as sunlight that enters from the outside via the outer lens 4 enters from the upper inclined surface 31*d* of the inner lens 3 and is reflected by the rear surface portion 31*b*, and the high reflecting portion 54 is irradiated with light. This can make the inner lens 3 glitter in the daytime when the light emitting portion 21 of the light source unit 2 is not on. In addition, since the lower surface portion 53 other than the high reflecting portion 54 and the back surface portion 51 look dark, the inner lens 3 appears, and the designability featured by the shape of the inner lens 3 can be improved.

<Second Aspect>

According to the first aspect, the inner lens 3 includes a rear surface portion 31*b* facing the light source 2, a lower inclined surface 31*c* that tilts downward from a lower end of the front surface portion 31*a* to the rear side, and an upper inclined surface 31*d* that tilts upward from an upper end of the front surface portion 31*a* to the rear side, and a distance D1 between the front surface portion 31*a* and the rear surface portion 31*b* in the inner lens 3 is longer than a predetermined distance D0 that allows the light that has entered from the lower inclined surface 31*c* to be reflected by the rear surface portion 31*b* and then exit from the upper inclined surface 31*d* without being reflected by the front surface portion 31*a*.

According to the second aspect, the light R2 reflected by the high reflecting portion 54 can efficiently be caused to exit from the upper inclined surface 31*d*. Hence, the inner lens 3 can be made to glitter well.

The present invention is not limited to the above embodiments, and various changes and modifications can be made within the spirit and scope of the present invention. Therefore, to apprise the public of the scope of the present invention, the following claims are made.

The invention claimed is:

1. A lamp device for a vehicle, comprising:

a light source;

an inner lens configured to receive light of the light source; and a housing configured to cover a periphery of the light source and the inner lens, wherein when a traveling direction of a light beam with a largest light amount in the light emitted from the light source is defined as front, the housing includes a back surface portion located on a rear side of the inner lens, and a lower surface portion located on a lower side of the inner lens, the lower surface portion includes an extended portion extended to a front side of a front surface portion of the inner lens, the extended portion is provided with a high reflecting portion having a reflecting characteristic higher than that of a remaining portion of the housing, and the high reflecting portion guides, to the inner lens, light other than the light emitted from the light source.

2. The lamp device for a vehicle according to claim 1, wherein the inner lens includes a rear surface portion facing the light source, a lower inclined surface that tilts downward from a lower end of the front surface portion to the rear side, and an upper inclined surface that tilts upward from an upper end of the front surface portion to the rear side, and a distance between the front surface portion and the rear surface portion in the inner lens is longer than a predetermined distance that allows the light that has entered from the lower inclined surface to be reflected by the rear surface portion and then exit from the upper inclined surface without being reflected by the front surface portion.

* * * * *